US009441327B2

(12) United States Patent
Ullmann et al.

(10) Patent No.: US 9,441,327 B2
(45) Date of Patent: Sep. 13, 2016

(54) DIMENSIONALLY STABLE PAPER AND PRODUCTION METHOD THEREOF

(71) Applicant: AHLSTROM CORPORATION, Helsinki (FI)

(72) Inventors: Bernd Ullmann, Bockau (DE); Holger Arnold, Wallenhorst (DE)

(73) Assignee: AHLSTROM CORPORATION, Helsinki (FI)

( * ) Notice: Subject to any disclaimer, the term of this patent is extended or adjusted under 35 U.S.C. 154(b) by 0 days.

(21) Appl. No.: 14/412,072

(22) PCT Filed: Jun. 26, 2013

(86) PCT No.: PCT/FI2013/050701
§ 371 (c)(1),
(2) Date: Dec. 30, 2014

(87) PCT Pub. No.: WO2014/006268
PCT Pub. Date: Jan. 9, 2014

(65) Prior Publication Data

US 2015/0152604 A1 Jun. 4, 2015

(30) Foreign Application Priority Data

Jul. 3, 2012 (EP) ..... 12004946

(51) Int. Cl.

| | |
|---|---|
| ***D21H 27/14*** | (2006.01) |
| ***D21H 19/20*** | (2006.01) |
| ***D21H 19/22*** | (2006.01) |
| ***D21H 19/24*** | (2006.01) |
| ***D21H 19/28*** | (2006.01) |
| ***D21H 19/30*** | (2006.01) |
| ***D21H 23/34*** | (2006.01) |
| ***D21H 27/20*** | (2006.01) |
| ***D21H 17/06*** | (2006.01) |
| ***D21H 17/08*** | (2006.01) |
| ***D21H 17/53*** | (2006.01) |

(52) U.S. Cl.

CPC ..... *D21H 27/14* (2013.01); *D21H 17/06* (2013.01); *D21H 17/08* (2013.01); *D21H 17/53* (2013.01); *D21H 19/20* (2013.01); *D21H 19/22* (2013.01); *D21H 19/24* (2013.01); *D21H 19/28* (2013.01); *D21H 19/30* (2013.01); *D21H 23/34* (2013.01); *D21H 27/20* (2013.01); *Y10T 428/3179* (2015.04); *Y10T 428/31591* (2015.04); *Y10T 428/31841* (2015.04); *Y10T 428/31851* (2015.04); *Y10T 428/31895* (2015.04); *Y10T 428/31906* (2015.04); *Y10T 428/31975* (2015.04)

(58) Field of Classification Search

CPC ..... D21H 17/06; D21H 17/08; D21H 17/53; D21H 19/20; D21H 19/22; D21H 19/24; D21H 19/28; D21H 19/30; D21H 23/34; D21H 27/14; D21H 27/20

USPC ..... 427/439; 156/279, 307.4

See application file for complete search history.

(56) References Cited

U.S. PATENT DOCUMENTS

| | | | | | |
|---|---|---|---|---|---|
| 2,268,674 | A | * | 1/1942 | Roth | 106/287.18 |
| 2,629,674 | A | * | 2/1953 | Ericks | 8/115.6 |
| 2,680,734 | A | * | 6/1954 | Dearing | 528/261 |
| 3,026,241 | A | * | 3/1962 | Hechtman et al. | 162/135 |
| 4,589,985 | A | * | 5/1986 | Yorke | 210/699 |

FOREIGN PATENT DOCUMENTS

| | | |
|---|---|---|
| JP | 2010/065361 | 3/2010 |
| KR | 20020055742 | 7/2002 |
| WO | WO 97/35687 | 10/1997 |

OTHER PUBLICATIONS

International Search Report for PCT/FI2013/050701, mailed Sep. 25, 2013, 5 pages.

Written Opinion of the International Searching Authority for PCT/FI2013/050701, mailed Sep. 25, 2013, 5 pages.

PCT Notification Concerning Transmittal of International Preliminary Report on Patentability (IPRP), issued in corresponding PCT International Application No. PCT/FI2013/050701, filed Jun. 26, 2013 (7 pages) mailed Jan. 15, 2015.

* cited by examiner

*Primary Examiner* — Thao T Tran

(74) *Attorney, Agent, or Firm* — Nixon & Vanderhye P.C.

(57) ABSTRACT

A dimensionally stable paper and paper products, a production method for such paper, and uses of substances for conveying, modifying or improving dimensional stability of paper.

18 Claims, No Drawings

DIMENSIONALLY STABLE PAPER AND PRODUCTION METHOD THEREOF

RELATED APPLICATIONS

This application is the U.S. national phase of PCT/FI2013/050701 having an international filing date of Jun. 26, 2013, which designated the U.S., and claims priority to European Patent Application 12004946.5 filed Jul. 3, 2012, the entire contents of each of these applications are hereby incorporated by reference.

BACKGROUND AND SUMMARY OF THE INVENTION

The present invention relates to a dimensionally stable paper and paper products, a production method for such paper, and uses of substances for conveying, modifying or improving dimensional stability of paper.

When cellulosic paper gets into contact with water, e.g. with water-based glues, wallpaper glue and poster glues, the cellulose fibers swell. This leads to a change in size of the paper by expansion into the wet state and shrinking into the dry state. For paper manufacturing on a Fourdrinier machine cellulose fibers are mainly aligned in the direction of production, i.e. in longitudinal direction. This alignment is favored by the pulling force exerted by the paper machine on the paper web. Swelling of cellulose fibers thus leads to dimensional changes, also called wet expansion, mainly in transverse direction of the paper web. Such expansion is generally not desirable; instead, dimensional stability in wet and air-dry conditions is considered favored.

Such dimensional changes are objectionable particularly for such applications where dimensional constancy in air-dry and wet conditions is mandatory. Particularly for wallpapers only a minimal change in dimensions is allowable. Wallpapers are normally adhered to a solid carrier in a wet state, either by applying a water-based glue to the wallpaper before pasting the then wet wallpaper to the solid carrier ("wet paste technique" or "Naβklebetechnik"), or by applying a water-based glue directly to the solid carrier and pasting the still dry wallpaper thereon ("Wandklebetechnik" or "paste-the-wall-technique").

In either case the wallpaper will absorb water such that cellulose fibers of the paper will expand. After pasting of the wallpaper onto the solid carrier normally a further wallpaper is pasted adjacent to the first wallpaper. In such configuration, shrinkage of wallpaper webs will result in gap formation between formerly adjacent paper webs, which is highly undesirable. And if a wallpaper web is pasted on a solid carrier before the paper web is fully expanded, then the paper web will continue to expand on the solid carrier, leading to the undesirable development of folds, bubbles and raised edges.

Similar problems occur when using water-based glues for application of posters and when printing on paper using Coldset inks. However, also for other applications dimensional expansion is undesirable, e.g. for art paper, intaglio printing paper and paper for maps and cards.

To achieve dimensional stability it has been suggested to include synthetic fibers to produce a waterleaf paper ("Vliespapier"). As synthetic fibers have a low wet expansion the paper web is internally stabilized against significant wet expansion. However, a disadvantage of waterleaf paper production is the high production costs. To prevent synthetic fibers from spinning ("verspinnen") the fibers have to be highly diluted in water. The headbox fiber suspension concentration generally is not more than 0.2 wt.-%. This results in a high energy demand for water circulation. Also, synthetic fibers are prone to dust generation and are generally not biologically degradable.

Also for papers other than waterleaf papers it has been tried to achieve improved dimensional stability by inclusion of synthetic fibers. For example WO 2008040635 A1 describes a method for production of a wallpaper substrate that can be peeled in a dry manner and having minimal wet expansion. In this method a multilayer substrate is produced having a lower layer for direction to a wall and an upper layer for direction to the room. A fibrous lower layer of a mixture of cellulosic and synthetic fibers is felted with a fibrous upper layer free of synthetic fibers. Again, production costs are disadvantageous, the method is considered cumbersome and the wallpaper substrate is prone to curling due to the differences in expansion capability of the layers.

Another wallpaper substrate is described in EP 1914087 A1; this wallpaper also has a nonwoven substrate comprising up to 50 wt.-% in synthetic fibers. Again, use of synthetic fibers is disadvantageous as described above.

It has been suggested in JP 2009096108 A to produce a wallpaper substrate comprising a layer of an expanded resin. A disadvantage of an expanded resin surface layer is that such papers can only be used in limited applications, and particularly cannot be generally used for wallpapers.

In a similar manner EP 98971 A2 discloses a structural wallpaper with a visible surface which is relief-like and may be painted over. The wallpaper consists of an embossed wallpaper substrate provided with an embossing on both faces, wherein to the reverse face of the embossed wallpaper a smooth paper, for example, waste paper, is glued. By using a water insoluble and water impenetrable glue areas are formed which do not absorb water and hence do not swell and expand. A disadvantage of such wallpaper is that the wallpaper substrate necessarily is embossed, limiting the usefulness of the wallpaper only to wallpaper applications and further limiting the possibilities of additional modifications of the wallpaper. Also the manufacturing method is rather laborious.

In WO 2005095712 A1 a wallpaper is described which is preferably free of synthetic fibers. The wallpaper consists of a number of layers, wherein a hydrophobic barrier layer is intended to separate the remaining wallpaper from a hydrophilic layer for gluing of the wallpaper to a wall. This was water absorption and wet expansion should be limited to the very layer used for gluing of the wallpaper to the wall. However, a disadvantage of this wallpaper is that the corresponding manufacturing method is cumbersome and the resulting wallpaper is inherently prone to curling.

It was thus an object of the present invention to provide a paper and paper product having low wet expansion in the wet state. The disadvantages described above should be avoided or reduced wherever possible. The paper should be useful in various fields of application, particularly for the production of wallpapers, but also for art papers, poster papers, intaglio papers and map and card papers. The paper should adhere to a wall when applied using wet paste technique or paste-the-wall-technique. In addition, the freshly applied paper should remain slidable for some time and have sufficient wet strength and dry strippability. The paper should have a good printability and preferably a low content of synthetic fibers. An object of the invention also was to provide manufacturing methods for producing such papers and paper products, and to provide uses of substances and mixtures for conveying, modifying or improving dimensional stability of paper and paper products.

According to the invention there is thus provided a dimensionally stable paper. The paper according to the invention comprises a raw paper impregnated at least on one face with an impregnation mixture comprising a sugar alcohol, urea and at least one substance selected from a polyalkylene glycol and glycerin. The paper according to the invention solves the above object of the invention and reduces or avoids the drawbacks of the prior art, particularly by exhibiting the features of preferred embodiments of the invention.

DETAILED DESCRIPTION OF THE INVENTION

It has surprisingly been found that a good dimensional stability can be conveyed to a paper while maintaining sufficient wet strength and dry strippability by impregnating a raw paper on at least one face with urea, a sugar alcohol—preferably sorbitol—and a polyalkylene glycol—and/or glycerin, wherein the content of synthetic fibers of the raw paper need not exceed 5 wt.-% (dry weight).

A paper according to the invention is a generally flat composite consisting mainly of fibers and made by dewatering on a sieve. By dewatering a felt is produced which can thereafter be compressed and dried. The fibers can be natural and synthetic fibers. However, a nonwoven fleece according to the invention is not considered a paper; a nonwoven is according to the invention considered a fleece if, according to EN 29092:1992 a) more than 50 wt.-% of the fibrous mass consist of fibers (except chemically digested plant fibers) having a length to diameter ratio (slimness) of more than 300; or, if the conditions of a) are not fulfilled, then
b) if the following conditions are fulfilled:
   1) more than 30 wt.-% of the fibrous mass consist of fibers (except chemically digested plant fibers) having a length to diameter ratio (slimness) of more than 300 and
   2) the density is less than 0.40 g/cm$^3$.

For these definitions, rayon fibers are not considered chemically digested plant fibers, and density is determined according to the methods described in ISO 90731 and ISO 90732. In a good approximation it can be observed that fleeces are not stabilized by hydrogen bonds, contrary to paper.

The paper according to the present invention comprises a sugar alcohol or a mixture of two or more sugar alcohols. A sugar alcohol is according to the invention a substance of general formula $HOCH_2[CH(OH)]_nCH_2OH$ wherein n=2, 3, 4 or 5, preferably 3 or 4. Particular sugar alcohols according to the invention are:

C4-sugar alcohols (n=2): (2R,3S)-butane-1,2,3,4-tetraol (Erythritol); (2S,3R)-butane-1,2,3,4-tetraol (Threitol)

C5-sugar alcohols (n=3): (2R,4R)-pentane-1,2,3,4,5-pentol (D-Arabinitol); (2R,4S)-pentane-1,2,3,4,5-pentol (Xylitol); (2S,4S)-pentane-1,2,3,4,5-pentol (L-Arabinitol)

C6-sugar alcohols (n=4): (2R,3R,4R,5R)-hexane-1,2,3,4,5,6-hexol (D-Mannitol); 2R,3R,4R,5S-hexane-1,2,3,4,5,6-hexol (Sorbitol); (2R,3R,4S,5R)-hexane-1,2,3,4,5,6-hexol; (2R,3R,4S,5S)-hexane-1,2,3,4,5,6-hexol (Allitol); (2R,3S,4R,5R)-hexane-1,2,3,4,5,6-hexol (D-Talitol); (2R,3S,4R,5S)-hexane-1,2,3,4,5,6-hexol (D-Galactitol, Dulcitol); (2R,3S,4S,5R)-hexane-1,2,3,4,5,6-hexol (D-Iditol); (2R,3S,4S,5S)-hexane-1,2,3,4,5,6-hexol (L-Glucitol); (2S,3R,4R,5R)-hexane-1,2,3,4,5,6-hexol; (2S,3R,4R,5S)-hexane-1,2,3,4,5,6-hexol (L-Iditol); (2S,3S,4R,5R)-hexane-1,2,3,4,5,6-hexol; (2S,3S,4R,5S)-hexane-1,2,3,4,5,6-hexol (L-Talitol); (2S,3S,4S,5S)-hexane-1,2,3,4,5,6-hexol (L-Mannitol).

Preferred sugar alcohols according to the invention are sorbitol and xylitol, particularly preferred is sorbitol. Further, mixtures of sugar alcohols are preferred having a content of sorbitol and xylitol of at least 50 mol-% of the total of sugar alcohols of the invention having n=2 to 5. Particularly preferred are such mixtures where the content of sorbitol is at least 50 mol-% of the total of sugar alcohols according to the invention having n=2 to 5.

The usefulness of sugar alcohols and particularly of sorbitol for conveying or improving dimensional stability in paper manufacturing had been surprising, particularly as it was known to the skilled person that water-based solutions of sorbitol are very sticky and tend to gum up a paper machine, such that frequent web ruptures and web imperfections would have to be expected. However, it has now been found that sorbitol can be used economically in combination with urea and a polyalkylene glycol, preferably polyethylene glycol, and glycerin optionally or instead of polyalkylene glycol(s).

The paper according to the invention comprises at most 5 wt.-% of synthetic fibers relative to the total mass of fibers of the raw paper, calculated in the dry state. Particularly preferred is a content of synthetic fibers of at most 1 wt.-% relative to the total mass of fibers of the raw paper, even more preferred at most 0.5 wt.-% of the total mass of fibers of the raw paper. Most preferred are papers devoid of synthetic fibers. According to the invention, synthetic fibers are non-natural polymeric fibers (excluding rayon), particularly fibers of polyester, polyethylene, polypropylene and particularly polycaprolactone (PCL), polyethylenadipate (PEA), polyhydroxyakanoate (PHA), polyethylenterephthalate (PET), polybutylenterephthalate (PBT), polytrimethylenterephthalate (PTT), polyurethanes (PUR), polyethylennaphthalate (PEN), polyacrylnitrile and polyamide(s)/Nylon.

References to dry weight according to the invention shall be understood as references to the weight obtained after drying in an oven at 130° C. until constancy of weight is achieved. However, references to dry weight of the paper of the present invention are to be understood as the equilibrium weight in dry air (see infra).

The preferred polyakylene glycol is according to the invention polyethylene glycol. Wherever this invention is described herein with reference to polyalkylene glycol(s), at least polyethylene glycol is meant thereby as well. According to the invention the polyethylene glycol has a molecular weight of 300 to 800 g/mol, preferably 400 to 600 g/mol. Such polyethylene glycol can be dissolved in water easily.

The paper of the invention comprises in its air-dry state a total of urea, sugar alcohol—preferably sorbitol—and polyalkylene glycol—preferably polyethylene glycol—and/or glycerin of at least 10 wt.-% relative to the total of dry fiber of the raw paper, preferably 15-40 wt.-% and particularly preferably 18-35 wt.-%. With these impregnation coats best dimensional stability and simultaneously good wall adhesiveness, wet strength, dry strippability and printability could be achieved in experiments so far.

Particularly preferred is a paper which is, on the face impregnated with urea, sugar alcohol—preferably sorbitol—and polyalkylene glycol—preferably polyethylene glycol—and/or glycerin, additionally impregnated with (a) a latex, or (b) a dry strength agent ("Trockenverfestiger"). Latex and dry strength agent additionally improve web strength. Usefulness of these substances was surprising, because latex and dry strength agents do not significantly improve dimensional stability of the paper, so it had to be expected that addition of these substances would, by dilution, reduce effectiveness of the substances impregnated to achieve dimensional stability, i.e. urea, sugar alcohol—preferably sorbitol—and polyalkylene glycol—preferably polyethylene glycol—and/or glycerin.

The latex according to the invention is a polymer dispersed in a water based medium. The latex preferably is selected from the group consisting of polyacrylnitrils, polyacrylates, polyvinylacetates, styrolacetatecopolymers, styrolacrylatecopolymers, styrolbutadienecopolymers, polyethylenterephthalates and polyurethanes and mixtures of two or more of these substances. The latex particularly improves wet strength of the paper of the present invention. Particularly preferred as latex are styrol-acrylate-copolymers, polyethyleneterephthalates and polyurethanes. Examples of preferred styrol-acrylate-copolymers are Revacryl 385 (synthomer) and Acronal S728 (BASF).

The dry strength agent of the paper of the invention preferably is a polymer (a) made with one or more of the monomers acrylic acid and acrylamide, or is (b) a terpolymer comprising hydroxy groups made with the monomers acrylic acid, acrylamide and (hydroxyethyl)methacrylate, or is (c) a mixture of polymers according to (a), a mixture of polymers according to (b) or a mixture of polymers according to (a) and polymers according to (b). Particularly preferred is a terpolymer comprising hydroxy groups made with the monomers acrylic acid, acrylamide and (Hydroxyethyl) methacrylate (HEMA).

Preferred dry strength agents are (trade names of Cebra) LZ9, which is a crosslinkable copolymer of polyacrylic acid and polyacrylamide, and EM1, which is a terpolymer comprising hydroxy groups of acrylamide, acrylic acid and HEMA.

On its impregnated face the paper of the present invention preferably is also impregnated with a) a wetting agent, preferably selected from terpenic wetting agents and di(2-ethylhexyl) sulfosuccinate salts, and/or b) a coagulant releasing aluminum ions, preferably polyaluminumchloride and/or aluminum sulfate.

The wetting agent improves fast entry of the water based impregnation mixture comprising urea, sugar alcohol—preferably sorbitol—and polyalkylene glycol—preferably polyethylene glycol—and/or glycerin into the raw paper web in a conventional paper machine. This way even and complete impregnation of the paper on the impregnated face can be secured. Examples of preferred wetting agents according to the invention are Eurosperse PL and Tallofin OF.

The coagulant ("Fällungsmittel") releasing aluminum ions allows to coagulate ("fällen") the latex of the impregnation mixture in such way that the latex can exert its influence in the paper of the invention and also can be impregnated evenly. Use of the coagulant releasing aluminum ions is described below in more detail. The coagulant in combination with the latex further improves dimensional stability, putatively by formation of aluminum hydroxide-latex-complexes, and also reduces stickiness of the impregnation mixture and good machine runnability on a conventional paper machine. The mode of action of the coagulant releasing aluminum ions and of the dry strength agent are described below in greater detail in connection with the production method of the present invention.

The ratio of the total of sugar alcohols (i.e. having n=2 to 5), or, if only one sugar alcohol is present (preferably sorbitol), the ratio of sugar alcohol to urea is (dry weights) 80:20 to 20:80, preferably 75:25 to 30:70. With these ratios a good dimensional stability is achieved, and the paper when used as a wallpaper exhibits good adhesion to a solid carrier.

The ratio (dry weights each) of latex to a) the total of sugar alcohols—preferably sorbitol—, is preferably: 5.95 to 15:85, more preferably 8.92 to 12:88, and/or b) urea is preferably: 15:85 to 30:70, more preferably 22:78 to 28:72.

Also, the ratio of dry strength agent to a) the total of sugar alcohols—preferably sorbitol—, is preferably: 5.95 to 20:80, more preferably 8.92 to 15:85, and/or b) urea is preferably: 12:88 to 21:79, more preferably 13:87 to 18:82.

The ratios given above are calculated on a dry weight basis.

According to the invention, a paper having the following properties is preferred:

i. The paper is impregnated only with one C5- and/or one C6-sugar alcohol, wherein the C5-sugar alcohol preferably is xylitol and the C6-sugar alcohol is sorbitol. Particularly preferred is a paper impregnated with sorbitol as only sugar alcohol.

ii. The ratio of the total of C5- and C6-sugar alcohols to urea is 75:25 to 30:70 (dry weights), wherein no other sugar alcohols are present in the impregnated paper.

iii. The ratio of latex to the total of C5- and C6-sugar alcohols is 8:92 to 12:88, and the ratio of latex to urea is 22:78 to 28:72, each ratio calculated on dry weight basis.

iv. As an alliterative to iii) the ratio of dry strength agent to the total of C5- and C6-sugar alcohols is 8.92 to 15:85 and the ratio of dry strength agent to urea is 13:87 to 18:82; the dry strength agent being a polymer made with the monomers acrylic acid, acrylamide and optionally (hydroxyethyl)methacrylate.

v. The polyalkylene glycol is polyethylene glycol, and the total of polyethylene glycol, preferably a polyethylene glycol of molecular weight of 400-600 g/mol, is 4-8 wt.-% based on the total of C5- and C6-sugar alcohols and urea (dry weights), preferably 5 to 6 wt.-%.

With these properties a paper is obtained having good dimensional stability and simultaneously good dry and wet strength, printability and low tendency of curling even when impregnated only on one face.

The paper according to the invention can be impregnated on one or both faces as described above. A paper impregnated on both faces is characterized by a further improved (i.e. diminished) tendency of curling when compared to a paper impregnated on one face only, and also has a good dry strippability.

According to the invention there is also provided a method for producing a paper having good dimensional stability, comprising the steps of producing a water based impregnation mixture comprising a sugar alcohol of general formula $HOCH_2[CH(OH)]_nCH_2OH$ wherein n=2, 3, 4 or 5, preferably 3 or 4, urea and a polyalkylene glycol and/or glycerin; and impregnating a raw paper with the impregnation mixture.

Such method allows surprisingly as described above obtaining a paper having high dimensional stability.

Preferably, the method according to the present invention comprises the steps:

I. producing of a water-based impregnation mixture comprising at least one or more sugar alcohols as described above, urea and one or more polyalkylene glycols, preferably polyethylene glycol, and additionally to the polyakylene glycol(s) or in alternative thereto glycerin, and a) a latex dispersed in the mixture, wherein the latex preferably is selected from the group consisting of polyacrylnitrils, polyacrylates, polyvinylacetates, styrol-acetate-copolymers, styrol-acrylate-copolymers, styrol-butadiene-copolymers, polyethyleneterephthalates and polyurethanes and mixtures of two or more of these substances, and wherein the impregnation mixture has a pH of more than 7, preferably a pH of 7.8 to 10, and wherein the total content of latex is preferably 5 to 25 wt.-% of the mixture, more preferably 7 to 15 wt.-%, calculated on a dry weight basis, or b) a dry strength agent, the dry strength agent preferably comprising a polymer made with one or more of the monomers acrylic acid and acrylamide or a terpolymer having hydroxy groups and being made using the monomers acrylic acid, acrylamide and (hydroxyethyl) methacrylate, wherein the impregnation mixture has a pH of at most 7, preferably at most 6.8 and particularly preferred 6 to 6.5, and wherein the total content of dry strength agent preferably is at least 10 wt.-% of the mixture, more preferably 20-40 wt.-%, II. lowering of the pH of the impregnation mixture to at most 5.5 by addition of a coagulant releasing aluminium ions, preferably polyaluminiumchloride and/or aluminum sulfate, preferably to a pH of 3 to 5.0, and III. raising the pH at least to the values indicated in step i) for alternative a) or b), respectively, IV. impregnating a raw paper with the impregnation mixture of step iii).

This method of the present invention allows producing a paper according to the present invention and thus allows achieving the above described advantages of said paper. Further the method is easy to implement and to perform. Only such substances are required which the skilled person can handle safely and easily.

The method of the present invention and the corresponding paper of the present invention start from a raw paper suitable for further manufacturing steps to produce a desired paper product. The raw paper is according to the invention preferably produced from a fiber mixture comprising one or more of the following fibers: TMP (thermomechanical pulp), CTMP (chemi-thermomechanical pulp), recycled fibers and cellulose ("Zellstoff"). The beating degree of the fiber or, if more than one fiber material is used, the beating degree of the fibers is preferably 25 to 50° SR, the content of deinked pulp thus preferably is not more than 25 wt.-% of the fiber mixture. Preferably the raw paper is manufactured from a fiber mixture comprising at least 50 wt.-% of TMP and cellulose ("Zellstoff") relative to the total of fiber materials, wherein the ratio of cellulose to TMP (dry weights) is 10.90 to 100:0, particularly preferred is a ratio of 30:70 to 60:40. With these contents of TMP a paper of very high dimensional stability can be obtained.

Preferably the content of synthetic fibers of the fiber mixture is at most 5 wt.-% relative to the total fiber dry weight, particularly preferred is a content of at most 1 wt.-%. It is an advantage of the manufacturing method of the present invention and correspondingly also an advantage of the paper of the present invention that for obtaining of the good or outstanding dimensional stability synthetic fibers can be completely absent but are still tolerable.

The raw paper is according to the invention impregnated with an impregnation mixture as described above. Impregnation can be performed in the paper machine. Preferably the raw paper is impregnated after a drying step in the paper machine. However, impregnation of the raw paper is also possible after the raw paper leaves the paper machine, for example by unrolling the raw paper off a parent roll ("Tambour"), impregnating of the raw paper on one or both faces with the impregnation mixture as described above, drying and reeling the impregnated paper on another roll.

The carrier of the impregnation mixture is water. The solids content of the impregnation mixture is preferably 10 to 70 wt.-% of the total impregnation mixture, more preferably 52-66 wt.-%. Solids content is preferably measured by arasometry. At the solids content suggested according to the present invention an even and fast impregnation even of dry solids of the raw paper dry weight, preferably 15-40 wt.-% and particularly preferably 18-35 wt.-%. Further, loss of substances which do not stick to the raw paper upon impregnation can be minimized. Thus, the load of effluent water with chemical and particularly chemical oxygen demand can be minimized.

The impregnation mixture comprises at least one sugar alcohol or a mixture of sugar alcohols. Preferred sugar alcohols and mixtures thereof are described above.

The polyalkylene glycol used according to the invention and particularly the polyethylene glycol used according to the present invention is also described above. Polyethylene glycol is dissolved in the impregnation mixture. In such cases where the polyakylene glycol and particularly polyethylene glycol or the mixture of polyalkylene glycols or polyethylene glycols, respectively, is not provided in a liquid state, such glycol or mixture is liquefied by warming, preferably by heating to a temperature of 40-80° C.

The impregnation mixture is preferably prepared by first dissolving the one or more sugar alcohols, polyalkylene glycols—preferably polyethylene glycol—and/or glycerin in water, then solid urea powder or granules are added and finally a latex dispersion or a dry strength agent is added to the mixture, wherein the mixture is maintained at 20 to 25° C. Latex and dry strength agent are described above in more detail.

After mixing of the one or more sugar alcohols—preferably sorbitol—, urea, polyethylene glycol (and/or another polyakylene glycol) and/or glycerin and the latex the pH of the impregnation mixture is more than 7, preferably 7.8 to 10. After mixing of the one or more sugar alcohols—preferably sorbitol—, urea, polyethylene glycol (and/or another polyalkylene glycol) and/or glycerin and the dry strength agent the pH of the impregnation mixture is at most 7, preferably 6.8 and most preferably 6.0 to 6.5.

After this, the pH of the impregnation mixture is lowered to at most 5.5 preferably 3 to 5.0.

Lowering of pH is performed according to the invention by addition of a coagulant releasing aluminum ions, preferably polyaluminumchloride and/or aluminum sulfate. Preferred coagulants are Sachtoklar 39 (Sachtleben Chemie) and Gilufloc 40 (Giulini).

The coagulant surprisingly allows to achieve a significant increase in machine runnability ("Maschinengängigkeit") and penetration ability of the impregnation mixture without requiring a permanently reduced pH of the impregnation mixture. Without the coagulant releasing aluminum ions the impregnation mixture tends to have a soap-like, greasy character resulting in a slow penetration into raw paper, which would make manufacture of the paper of the present invention difficult on common paper machines. Use of the coagulant, however, results in a reduction of pH of the impregnation mixture. It has surprisingly been found that the pH of the mixture can be raised again without loss of machine runnability and penetration characteristics of the impregnation mixture and also without compromising dimensional stability of the paper of the present invention. This also holds true for impregnation mixtures which do not comprise latex or dry strength agent(s).

The inventors further have found that trivalent cations other than aluminum do not allow to obtain such good or excellent dimensional stability at the costs of the present invention. At the pH of at most 5.5, preferably 3.0-5.0 particularly preferably at most 4.5 $Al_3^+$ cations and other ions comprising aluminum like $AlCl_2^+$, $AlNO_3^{2+}$, $Al(OH)_2^+$ and so on are formed. If the impregnation mixture comprises a latex, then these ions will form coagulates with the dispersed latex particles. The impregnation mixture will turn more viscous and can even have a pasty character. If the impregnation mixture comprises a dry strength agent instead of latex, then no obvious coagulation occurs, as the dry strength agent comprises acidic groups on its own. Viscosity of such impregnation mixture does not change significantly upon reduction of pH. Nevertheless the impregnation mixture is "dulled" and is endued with improved machine runnability.

Afterwards the pH is raised again such that the margins described above in step i) in view of latex and dry strength agent, respectively, are again met. Thus the pH of impregnation mixtures comprising dry strength agents is after addition of a base at least 6 and at most 7, preferably at most 6.8 and particularly preferably 6.0 to 6.5; with impregnation mixtures comprising latex the pH is more than 7, preferably 7.8 to 10.

Raising of pH is preferably achieved by addition of solid NaOH or sodium hydroxide solution. It is presently believed that the structure of the coagulated latex is changed by such addition; the mixture is rendered less viscous but more opaque. An impregnation mixture comprising one or more dry strength agents the "dull" character is maintained; regardless of this wettability of paper is significantly improved compared to the previous acidic mixture. It was now surprisingly found that raising of pH is required to improve the good dimensional stability of the paper of the present invention.

After raising of the pH the impregnation mixture is ready for raw paper impregnation. The impregnation mixture can comprise further substances, e.g. mineral additives like kaolin, clay, potassium carbonate and talc as coating agents or extender pigments, for example to improve opacity, brightness, color retention and printability. Additional dry strength agents like starch and polyacrylamide can be comprised in the impregnation mixture as well as additional wet strength agents, e.g. epichlorohydrin. Addition of surfactants, e.g. anti-foam agents, can also be beneficial. The skilled person can include further substances according to his needs.

The raw paper is impregnated with the impregnated mixture in any suitable way, preferably by application on one or both faces using a size press, film press or bill blade.

The raw paper is preferably impregnated to achieve a solids addition of at least 15 wt.-% relative to the dry fiber weight of the raw paper, preferably 18 to 40 wt.-%. with this application of the impregnation mixture a good dimensional stability is obtained while maintaining low, tolerable losses of the impregnation mixture by impregnation. In summary the method of the present invention can be performed easily with conventional machinery, the method does not require high investments in machinery or chemicals and subsequent problems, e.g. chemical oxygen demand of effluent water, can be kept very low. Of course, the paper thus produced is characterized by good or even excellent dimensional stability.

The impregnated paper can then be dried to equilibrium dryness of a moisture content of preferably 10 to 12 wt.-%. Equilibrium dryness is determined at a temperature of 23° C. at a relative humidity of 50%.

The invention also teaches the use of an impregnation mixture comprising:

- one or more sugar alcohols of general formula $HOCH_2[CH(OH)]_nCH_2OH$ with n=2, 3, 4 or 5, preferably 3 or 4,
- urea,
- a polyalkylene glycol, preferably one or more polyethylene glycol(s), and/or glycerin for conveying, modifying or improving dimensional stability of a paper, preferably to a dimensional stability of at most 0.8% measured by the paper extension in completely wet and completely dry stage, more preferably at most 0.7%, even more preferably at most 0.6% and preferably at most 0.5%.

The invention is hereinafter described by examples. These examples are not intended to limit the scope of the claims.

Example 1

Raw Paper

A two-layered raw paper having a raw paper grammage of 80 g/m$^2$ was produced on a Duplex 5 paper machine:

A water-based fiber mixture having 60 wt.-% TMP, 30 wt.-% long fiber pulp and 10 wt.-% waste paper (each relative to the total fiber dry weight) was produced, the beating degree of the fiber material was 30° SR. In a similar manner, a one-layered paper of 80 g/m$^2$ grammage was produced on a Simplex paper machine using the water based fiber mixture as just given above.

The one- or two-layered paper web thus produced was furnished with fillers, dry strength agents (starch, polyacrylamide), wet strength agent (epichlorohydrine) and processing agents like defoamer, biocides and retention agent in a conventional manner: In stock 10 kg/t Talcum pigments Finntalc P10 are added. The paper was dried to equilibrium water content. In the pulper, 8.5 l/t of a polyacrylamide dry strength additive (Praestamin A-L) was added. In the mixing chest, 24 l/t of an epichlorohydrine wet strength agent (Kymene 217 LX) and 10 kg/t cationic starch (Solbond TC40) were added. Before the hydrocyclone (cleaner), 1 l/ton polyethyleneimine as retention system (Polymin SK) was added. The defoamer (Contraspum E 640) was added (1 l/t) in white water.

To determine dimensional stability rectangular strips of 210×50 mm were cut perpendicular to the main fiber direction of the dried paper 24 h after production, such that the short edges of each strip were located within the first or last fifth of the paper web width ("edge probing" instead of "mean probing"). On each strip two marks were applied having a distance of 180 mm to each other, the distance to the closest short strip edge was 15 mm and the distance to the long strip edge was 25 mm, respectively. The strips were then immersed in deionized water for 5 min to allow the strips to be completely wetted. After immersion the strips were taken out of the water and the distance between the marks on each strip was measured again immediately. Wet expansion (and correspondingly dimensional stability) is then calculated as the percentage of difference in marker distance before and after immersion in water (cf. Table 1 below):

TABLE 1

Conversion of distance change in % wet expansion The wallpaper raw paper produced as described above (one and two-layered paper) had a wet expansion of 2.0 to 2.2 %.

| Distance change [mm] | Wet expansion % |
|---|---|
| 0.1 | 0.06 |
| 0.2 | 0.11 |
| 0.3 | 0.17 |
| 0.4 | 0.22 |
| 0.5 | 0.28 |
| 0.6 | 0.33 |
| 0.7 | 0.39 |
| 0.8 | 0.44 |
| 0.9 | 0.5 |
| 1.0 | 0.56 |
| 1.1 | 0.61 |
| 1.2 | 0.67 |
| 1.3 | 0.72 |
| 1.4 | 0.78 |
| 1.5 | 0.83 |
| 1.6 | 0.89 |
| 1.7 | 0.94 |
| 1.8 | 1 |
| 1.9 | 1.06 |
| 2.0 | 1.11 |
| 2.1 | 1.17 |
| 2.2 | 1.22 |
| 2.3 | 1.28 |
| 2.4 | 1.33 |
| 2.5 | 1.39 |
| 2.6 | 1.44 |
| 2.7 | 1.5 |
| 2.8 | 1.56 |
| 2.9 | 1.61 |
| 30. | 1.67 |

Example 2

Wallpaper of the Invention

The wallpaper manufactured as described above was impregnated with an impregnation mixture according to the invention. The impregnation mixture was prepared by mixing the following substances, in the sequence given below:

| Substance | Commercial name | Concentration of stock | Parts volume added |
|---|---|---|---|
| Sorbitol | Neosorb 70/70 | 70.00% | 2500 l |
| Urea | Technical commodity | solid | 749 l (1000 kg) |
| Latex | Revacryl 385 | 50.00% | 525 l |
| Polyethylene glycol | PEG 400 | 100.00% | 150 l |
| Water | | | 850 l |

The mixture was stirred for 2 min to achieve a uniform and completely dissolved (the latex is of course only dispersed) mixture. Afterwards, polyaluminum chloride (Sachtoklar 39) was added, the pH was reduced to 4 to 4.5 (ca. 0.4 volume parts relative to 100 volume parts of Neosorb).

Then further substances were added, in the sequence given below:

| Substance | Commercial name | Concentration of stock | Parts volume added |
|---|---|---|---|
| Antifoam | Agitan731 | 100.00% | 8 l |
| NaOH | Technical commodity | 10.00% | 17 l to pH 8 |
| Dispersion aid | Eurosperse PL | 80.00% | 25 l |

An off-white impregnation mixture was obtained, having low viscosity and allowing rapid raw paper wetting at 25-350° C. The raw paper was impregnated to obtain a solids addition of 26.2 g/m$^2$. After drying the wet expansion was determined as described in example 1; wet expansion was 0.5% for two-layered and one-layered wallpaper.

Example 3

Map Paper According to the Invention

A raw paper of 90 g/m$^2$ grammage was produced on a Fourdrinier paper machine with integrated size press. For production pine sulfate pulp and aspen pulp (each bleached without elemental chlorine) were mixed in a dry mass ratio of 35:65 of pine pulp to aspen pulp. The pulp mixture was then milled to 25°SR (Schopper-Riegler).

In a mixer 10 vol.-% produce waste, 200 l/t kaolin slurry of 68 wt.-% were added to the pulp mixture. Brightening agents and colors were also added. The final solids content was 2.89 wt.-%. The mixture was diluted to 0.8 wt.-% in the constant part of the paper machine. Here 0.5 wt.-% (relative to the final paper weight) of polyaluminum chloride and 0.15 wt.-% (relative to the final paper weight) of anionic polyacrylamide (retention agent) and a biocide were added.

The raw paper produced from the mixture thus obtained was dried to a dry solids content of 95% and had a grammage of 90 g/m$^2$. The raw paper was entered into the size press of the paper machine and impregnated with the impregnation mixture as described in example 2.

After impregnation the paper web was dried, smoothened in a 4 barrel calender stack to 60 s (Bekk) and rolled on a parent roll. The paper properties were determined as given above in example 1:

| | Raw paper | Map paper according to the invention |
|---|---|---|
| Grammage | 100 g/m$^2$ | 118 g/m$^2$ |
| Wet expansion | 2.10% | 0.90% |

The dimensional stability of the map paper thus has been increased by approximately 57% by the impregnation according to the present invention.

Example 4

Wallpaper According to the Invention

A one-layered raw paper and a two-layered raw paper manufactured as described in example 1 were impregnated as described in example 2 with an impregnation mixture, wherein the impregnation mixture was obtained by mixing the following components in the sequence as given below:

| Substance | Wet weight (gram) | Dry weight (gram) |
|---|---|---|
| Sorbitol (Neosorb 70/70) | 120 | 84 |
| Urea (commodity) | 50 | 49 |

-continued

| Substance | Wet weight (gram) | Dry weight (gram) |
|---|---|---|
| Water | 40 | |
| Dry strength agent (EM1) | 42 | 8.4 |
| Wetting agent (Tallofin OF) | 10 | 3.5 |
| Alkylketendimer (Aquapel; Ashland) | 2.5 | 0.5 |
| Anionic tensides | 0.5 | 0.5 |
| Polyaluminum chloride (Sachtoklar 39) | 0.8 | 0.8 |
| NaOH | ad pH 8.5 | |

The following wet expansions were achieved:

| Paper | grammage [g/m$^2$] | Wet expansion [%] |
|---|---|---|
| One-layered raw paper | 84.8 | 1.7 |
| Impregnated one-layered paper | 110.2 | 0.3 |
| Two-layered raw paper | 109.4 | 2.1 |
| Impregnated two-layered paper | 141.2 | 0.5 |

The invention claimed is:

1. A method of producing a paper having good dimensional stability, comprising the steps of:

I. producing of a water-based impregnation mixture comprising at least a sugar alcohol having a general formula $HOCH_2[CH(OH)]_nCH_2OH$ wherein n=2, 3, 4 or 5, a urea, a polyalkylene glycol and/or glycerin, and a) a latex dispersed in the mixture, wherein the impregnation mixture has a pH of more than 7, or b) a dry strength agent, wherein the impregnation mixture has a pH of at least 6 and at most 7, II. lowering of the pH of the impregnation mixture to at most 5.5 by addition of a coagulant releasing aluminum ions, and III. raising the pH at least to the values indicated in step I) for alternative a) or b), respectively, and IV. impregnating a raw paper with the impregnation mixture of step III).

2. The method according to claim 1, wherein the impregnation mixture before step II) includes a dry weight ratio I. of the latex to a. the total of sugar alcohols is 5:95 to 15:85, and/or b. the urea is 15:85 to 30:70, or II. of the dry strength agent to a. the total of sugar alcohols is 5:95 to 20:80, and/or b. the urea is 12:88 to 21:79.

3. The method according to claim 1, wherein the latex is selected from the group consisting of polyacrylonitrile, polyacrylates, polyvinylacetates, styrol-acetate-copolymers, styrol-acrylate-copolymers, styrol-butadiene-copolymers, and a mixtures of two or more of these substances.

4. The method according to claim 1, wherein the dry strength agent comprising a polymer made with one or more of the monomers of acrylic and acrylamide or a terpolymer having hydroxyl groups and being made using the monomers of acrylic acid, acrylamide and (hydroxyethyl)methacrylate.

5. The method according to claim 1, wherein the raw paper is impregnated by an application of solids of at least 10 wt.-% relative to the raw paper dry weight.

6. The method according to claim 1, wherein the impregnation mixture in further comprises a wetting agent, selected from terpenic wetting agents and di(2-ethylhexyl) sulfosuccinate salts.

7. The method according to claim 1, wherein the ratio of sugar alcohol or, if more than one sugar alcohol is present in the impregnation mixture, the dry weight ratio of sugar alcohols to urea is 80:20 to 20:80.

8. The method according to claim 1, wherein the raw paper is produced from a fiber mixture comprising one or more of the following fibers: TMP (thermomechanical pulp), CTMP (chemi-thermomechanical pulp), recycled fibers and cellulose, wherein the dry weight ratio of cellulose to TMP is 10:90 to 100:0, and wherein the content of synthetic fibers is at most 5 wt.-% of the raw paper equilibrium dry weight.

9. The method according to claim 1, wherein the polyalkylene glycol is polyethylene glycol of a molecular weight of 300 to 800 g/mol, and wherein the amount of polyethylene glycol is 4 to 8 wt.-% based on the total of C5- and C6-sugar alcohols and urea dry weights.

10. A method for producing a paper having good dimensional stability, comprising the steps of:

I. producing a water based impregnation mixture comprising:

a sugar alcohol having a general formula $HOCH_2[CH(OH)]_nCH_2OH$ wherein n=2, 3, 4 or 5;

a urea; and a polyalkylene glycol and/or glycerin;

II. impregnating a raw paper with the impregnation mixture;

III. producing of a water-based impregnation mixture comprising at least:

a sugar alcohol having a general formula $HOCH_2[CH(OH)]_nCH_2OH$ wherein n=2, 3, 4 or 5;

a urea; and a polyalkylene glycol and/or glycerin; and a) a latex dispersed in the mixture, wherein the impregnation mixture has a pH of more than 7; or b) a dry strength agent, wherein the impregnation mixture has a pH of at least 6 and at most 7;

IV. lowering of the pH of the impregnation mixture of step III) to at most 5.5 by addition of a coagulant releasing aluminum ions; and V. raising the pH of the impregnation mixture of step IV) at least to the values indicated in step III) for alternative a) or b), respectively, and VI. impregnating a raw paper with the impregnation mixture of step V).

11. The method according to claim 10, wherein immediately before step III) the dry weight ratio I. of the latex to a. the total of sugar alcohols is 5:95 to 15:85, and/or b. the urea is 15:85 to 30:70, or II. of the dry strength agent to a. the total of sugar alcohols is 5:95 to 20:80, and/or b. the urea is 12:88 to 21:79.

12. The method according to claim 10, wherein the latex is selected from the group consisting of polyacrylonitrile, polyacrylates, polyvinylacetates, styrol-acetate-copolymers, styrol-acrylate-copolymers, styrol-butadiene-copolymers, and a mixtures of two or more of these substances.

13. The method according to claim 10, wherein the dry strength agent comprising a polymer made with one or more of the monomers of acrylic and acrylamide or a terpolymer having hydroxyl groups and being made using the monomers of acrylic acid, acrylamide and (hydroxyethyl)methacrylate.

14. The method according to claim 10, wherein the raw paper is impregnated by an application of solids of at least 10 wt.-% relative to the raw paper dry weight.

15. The method according to claim 10, wherein the impregnation mixture in further comprises a wetting agent, selected from terpenic wetting agents and di(2-ethylhexyl) sulfosuccinate salts.

16. The method according to claim 10, wherein the ratio of sugar alcohol or, if more than one sugar alcohol is present in the impregnation mixture, the dry weight ratio of sugar alcohols to urea is 80:20 to 20:80.

17. The method according to claim 10, wherein the raw paper is produced from a fiber mixture comprising one or more of the following fibers: TMP (thermomechanical pulp), CTMP (chemi-thermomechanical pulp), recycled fibers and cellulose, wherein the dry weight ratio of cellulose to TMP is 10:90 to 100:0, and wherein the content of synthetic fibers is at most 5 wt.-% of the raw paper equilibrium dry weight.

18. The method according to claim 10, wherein the polyalkylene glycol is polyethylene glycol of a molecular weight of 300 to 800 g/mol, and wherein the amount of polyethylene glycol is 4 to 8 wt.-% based on the total of C5- and C6-sugar alcohols and urea dry weights.

* * * * *